United States Patent [19]

Ou-Yang

[11] Patent Number: 4,778,698

[45] Date of Patent: Oct. 18, 1988

[54] INNERSEAL FOR CONTAINER FOR USE WITH LIQUID CONTENTS

[75] Inventor: David T. Ou-Yang, Woodbury, Minn.

[73] Assignee: Minnesota Mining and Manufacturing Company, St. Paul, Minn.

[21] Appl. No.: 30,730

[22] Filed: Mar. 26, 1987

[51] Int. Cl.[4] ..... B65D 53/04

[52] U.S. Cl. ..... 428/35; 215/232; 215/347; 428/344; 428/349; 428/458

[58] Field of Search ..... 428/35, 458, 480, 344, 428/349; 215/232, 341, 347

[56] References Cited

U.S. PATENT DOCUMENTS

| | | | |
|---|---|---|---|
| 2,937,481 | 6/1958 | Palmer | 215/347 |
| 3,832,314 | 8/1974 | Hoh et al. | 260/26 |
| 3,932,326 | 1/1976 | Hoh et al. | 260/26 |
| 3,959,062 | 5/1976 | Hoh et al. | 156/313 |
| 4,048,128 | 9/1977 | Eastman | 260/22 |
| 4,322,003 | 3/1982 | Long | 428/458 |
| 4,324,601 | 4/1982 | Dembicki et al. | 156/69 |
| 4,442,129 | 4/1984 | Niwa et al. | 215/347 |
| 4,503,123 | 3/1985 | Ou-Yang | 428/344 |
| 4,523,689 | 6/1985 | Laub | 215/232 |
| 4,579,240 | 4/1986 | Ou-Yang | 215/230 |
| 4,588,465 | 5/1986 | Paciorek | 215/347 |
| 4,596,338 | 6/1986 | Yousif | 215/347 |
| 4,666,052 | 5/1987 | Ou-Yang | 215/347 |
| 4,684,554 | 8/1987 | Ou-Yang | 428/349 |
| 4,686,133 | 8/1987 | Nakabayashi et al. | 428/344 |
| 4,693,385 | 9/1987 | Lamping et al. | 215/232 |

*Primary Examiner*—John E. Kittle
*Assistant Examiner*—James J. Seidleck
*Attorney, Agent, or Firm*—Donald M. Sell; David L. Weinstein

[57] ABSTRACT

Innerseal suitable for use with containers made from glass. The innerseal of this invention comprises a facing bearing a layer of amorphous polyester on one major surface thereof. The innerseal forms a strong bond to glass and resists moisture better than do conventional innerseals.

10 Claims, 1 Drawing Sheet

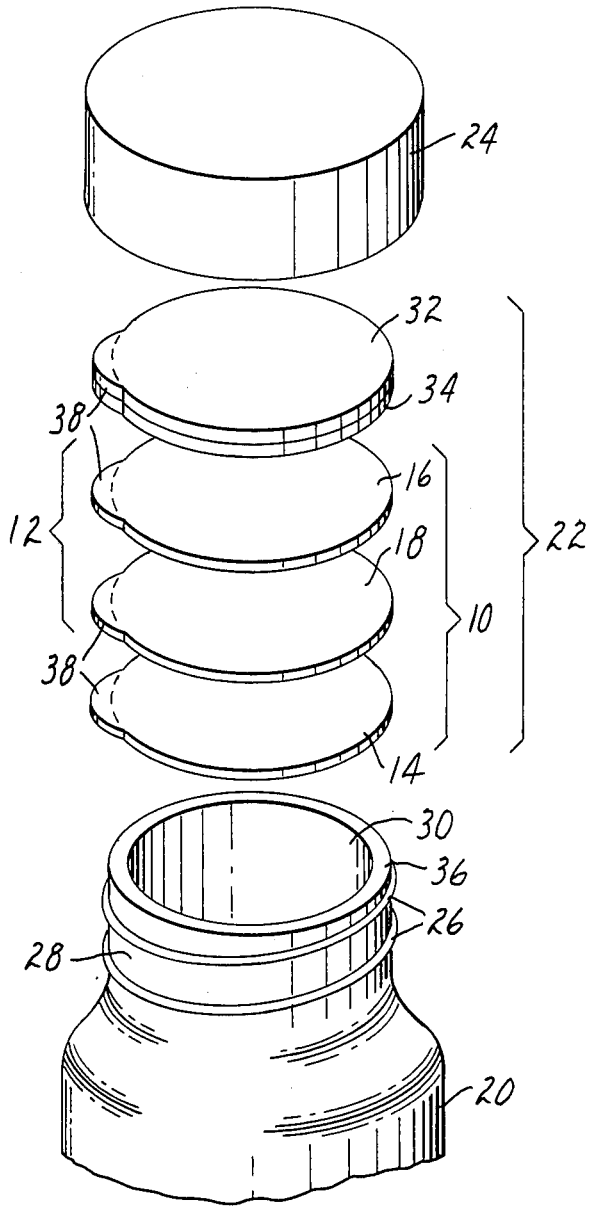
24
32
34
38
16
12
18
22
10
38
14
30
36
26
28
20

INNERSEAL FOR CONTAINER FOR USE WITH LIQUID CONTENTS

BACKGROUND OF THE INVENTION

This invention relates to innerseals for containers, and, more particularly, innerseals that are suitable for containers made of glass.

Heat-sealable innerseals have been found to be useful in sealing containers for liquid products, such as, for example, motor oil, brake fluid, antifreeze, household ammonia, liquid detergents, etc., which products present technical problems with respect to leakage. Heat-sealable innerseals have also become popular for providing the tamper-resistant innerseals that are required by the Food and Drug Administration for over-the-counter drugs.

Heat-sealable innerseals generally comprise a layer of aluminum foil bearing a coating of heat-sealable material thereon. The innerseals are inserted into caps, and the resulting assemblies are then supplied to the packager. The cap is then placed by the packager onto the filled container, with the coating of heat-sealable material being in contact with the lip or rim of the container. The container then passes under an induction heater which generates heat through the aluminum foil, thereby melting the heat-sealable coating, and causing the innerseal to bond to the container.

Heat-sealable innerseals applied by induction heating have been found to be especially useful with plastic caps and plastic container systems, as induction heating does not heat the plastic material excessively. Heat-sealable innerseals can also be used with metal caps in an induction heating system where the metal cap itself conducts heat to melt the heat-sealable material.

In the case of glass containers, however, heat-sealable innerseals will lose adhesion within days, even hours, however, upon exposure to moisture. This loss of adhesion occurs because the sodium ion, which is an essential component of many popular glass containers, gradually leaches out of the bulk of the glass and reacts with water in the air or in the container to form a layer of sodium hydroxide on the surface of the glass. It is this layer of sodium hydroxide that reduces the adhesion between the heat-sealed coating of the innerseal and the glass surface of the container.

One innerseal material in current use that overcomes the aforementioned problem is an ionomer sold under the trademark "Surlyn". However, this ionomer has a disagreeable odor and, at high temperatures, portions thereof leach into the liquid contents of the container.

SUMMARY OF THE INVENTION

In one aspect, this invention involves an innerseal that is especially useful for glass containers for packaging liquid products. The innerseal comprises a facing having a layer of amorphous polyester coated on one major surface thereof. In another aspect, this invention involves a container which employs the aforementioned innerseal.

The innerseal of this invention not only forms a strong bond to glass, but it also can be used for packaging any food product under any packaging conditions. The innerseal is particularly useful for glass containers that have been subjected to a fluoride treatment. Furthermore, the innerseal has no objectionable odor nor will components thereof leach into liquid materials present in the container. Finally, the innerseal of this invention resists moisture better than do conventional innerseals.

BRIEF DESCRIPTION OF THE DRAWING

The drawing is an exploded perspective view of one embodiment of the container of this invention.

DETAILED DESCRIPTION

The innerseal 10 of this invention comprises a facing 12 having coated on one major surface thereof a layer 14 comprising an amorphous polyester. As used herein, the term "amorphous polyester" means a polyester having a degree of crystallinity less than or equal to about 40%. It is preferred that the degree of crystallinity be less than about 10%. Amorphous polyesters that are suitable for this invention preferably have an intrinsic viscosity less than about 0.90, more preferably from about 0.40 to about 0.80, preferably have a glass transition temperature less than about 90° C., more preferably from about 25° C. to about 80° C., preferably have a softening point of at least about 25° C., more preferably of at least about 90° C., and preferably have either an acid number less than or equal to about 55, or an hydroxyl number less than or equal to about 50, or both, more preferably an acid number less than or equal to about 10 and an hydroxyl number less than or equal to about 10. Representative examples of amorphous polyesters typically include copolymers derived from (a) reacting at least two polyhydric alcohols with one organic acid or ester derived therefrom, (b) reacting at least two organic acids or esters derived therefrom with one polyhydric alcohol, or (c) reacting at least two organic acids or esters derived therefrom with at least two polyhydric alcohols. An example of an organic acid or derivative thereof suitable for preparing amorphous polyesters is phthalic acid or derivative thereof. Stated another way, amorphous polyesters are typically copolyesters. However, amorphous polyesters can be homopolymers. Examples of amorphous polyesters include one having the designation PETG 6763 (polyethylene terephthalate glycol), available from Eastman Chemical Products, Inc., which is derived from the reaction of dimethyl terephthalate with ethylene glycol and a second polyhydric alcohol, and one having the designation Vitel® VPE-4915 (dimethyl terephthalate-co-isophthalate), available from The Goodyear Tire and Rubber Co., which is derived from the reaction between dimethyl terephthalate, an isophthalate, and a polyhydric alcohol. Amorphous polyesters are also described in Encyclopedia of Polymer Science and Technology, Vol. 11, John Wiley & Sons, Inc. (New York: 1969), pp. 77–80, incorporated herein by reference. The facing 12 is preferably made of a metallic foil 16, e.g. aluminum, steel, or iron foil, with aluminum foil being preferred. The thickness of the foil is typically less than about 2.0 mils. The facing 12 can also be a laminate comprising metallic foil 16 and polymeric film 18, e.g. polyester or polyolefin film. Although in the embodiment shown in the drawing, the facing is shown to consist of a metallic foil 16 and a polymeric film 18, it is equally useful to employ an embodiment wherein the polymeric film 18 is eliminated.

The innerseal 10 can be prepared by coating the facing 12 with a solution containing the amorphous polyester. Alternatively, the polymeric film 18 and amorphous polyester layer 14 can be applied to metallic foil 18 by means of a co-extrusion process in order to form innerseal 10.

Materials suitable for the container of this invention include glass, polycarbonate, polyester, polyvinyl chloride, polystyrene, or other conventional container material. A material that is preferred for the container of this invention is described in U.S. Pat. No. 4,324,601, incorporated herein by reference. The glass prepared in accordance with U.S. Pat. No. 4,324,601 has a metal oxide coating on the inside surface of the container and a fluorochemical coating on the outside surface of the container. These two coatings minimize the amount of sodium ion that leaches from the bulk to the surface of the container to react with water to form an adhesion-reducing sodium hydroxide layer. The innerseal of the present invention has good affinity toward fluorochemicals on the surface of the rim of the container. The preferred glass material is soda-lime-silica glass because it is inexpensive, is durable, and is approved by the Food and Drug Administration.

The portion of the container that is to contact the innerseal is etched with a chemical composition containing a fluorine-containing compound and metal oxide precursor, preferably at a temperature ranging from about 800° F. to about 1200° F. The container is then annealed. After the annealing step, the exterior surfaces of the container are treated with a lubricious material, preferably at a temperature ranging from about 100° F. to about 300° F. The lubricious coating is then removed, preferably by heating at a temperature ranging from about 250° F. to about 350° F. Untreated glass and glass having lubricious coatings can also be used with the innerseal of this invention. However, these types of glass are preferably used to package dry materials. The glass of U.S. Pat. No. 4,324,601 can be used to package both wet materials and dry materials.

The innerseal 10 can be applied to the container 20 in a conventional manner. A cap liner generally designated by the reference numeral 22 is typically placed inside cap 24 by the cap manufacturer. The cap liner 22 is typically die cut from a web. Cap 24 is preferably formed of a polymer and has a top and connecting side walls with internal threads (not shown) to mate with threads 26 provided on the outer surface about the neck 28 and opening 30 of container 20. Cap 24 could be a snap fitted cap to mate with a rib formed about the opening of the container, such as conventional child-proof caps having an arrow thereon which is rotated to match an arrow or location on the container, at which location the cap may be snapped off. The threaded cap is chosen for purposes of illustration. Caps are supplied to the packager with the liner 22 already placed in the cap 24. Typically, the liner 22 is glued onto the inside of the cap 24. Liner 22 comprises a backing 32 bonded to the innerseal 10. In one embodiment of the liner, the backing 32 can be made of paper pulp board or chipboard and it can be bonded to the facing 12, i.e., the metallic foil 16, of the innerseal 10 by means of a layer 34 of wax. In another embodiment of the liner, the backing 32 can be made of polymeric foam or paper and it can be bonded to the facing 12 of the innerseal 10 by means of an adhesive, e.g., a polyurethane-based adhesive. Waxes and adhesives that are useful for bonding the liner to foil are well-known in the art and are described, for example, in U.S. Pat. No. 4,579,240, incorporated herein by reference.

The innerseal 10 can be bonded to the lip 36 of the container 20 by induction heating. As the innerseal 10 is passed through a conventional induction heating field, the metallic foil 16 of the facing 12 heats up instantaneously, causing a melting of layer 14 of amorphous polyester and resulting in subsequent bonding of the innerseal 10 to the lip 36 of the container 20. Alternatively, the metallic foil backing can be heated by conduction.

The innerseal 10 shown in the drawing is substantially of the same size and configuration as the opening 30 of the container 20. In the embodiment shown, the innerseal 10 has a small tab 38 extending from the periphery thereof. However, the innerseal does not require a tab. If the innerseal 10 has no tab, the ultimate consumer can puncture the innerseal 10 with a finger or a tool and then remove it from the container 20. If the innerseal 10 has a tab 38, the ultimate consumer can grasp the tab and then peel the innerseal 10 away from the lip 36 of the container 20.

The amorphous polyester layer 14 of the innerseal 10 can absorb some of the lubricious coating material from the lip of the container. By being capable of absorbing lubricious coating material, the possibility of a barrier film forming between the lip of the container and the innerseal is eliminated.

The major advantage of the innerseal of this invention is that it can be used with glass containers that contain water or other liquids. The amorphous polyester material of the innerseal will not leach into the liquid contained in the container. In addition, amorphous polyester bonds well to glass surfaces that have been treated with a fluorine-containing compound.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. Container made of glass that has been treated with a fluorine-containing compound, said container having an innerseal that comprises a facing bearing a coating of amorphous polyester thereon, said facing comprising metallic foil, said coating of amorphous polyester being in contact with the said container.

2. The container of claim 1 wherein the glass is a soda-lime-silica glass.

3. The container of claim 11 wherein said amorphous polyester has a degree of crystallinity equal to or less than 40%.

4. The container of claim 1 wherein said amorphous polyester has an intrinsic viscosity less than about 0.90, a glass transition temperature less than about 90° C., a softening point of at least about 25° C., an acid number less than or equal to about 55 or an hydroxyl number less than or equal to about 50 or both an acid number less than or equal to about 55 and an hydroxyl number less than or equal to about 50.

5. The container of claim 1 wherein said facing is a metallic foil.

6. The container of claim 1 wherein said facing is a laminate comprising metallic foil and polymeric film.

7. The container of claim 1 wherein said amorphous polyester is a copolymer derived from (a) reacting at least two polyhydric alcohols with one organic acid or esters derived therefrom, (b) reacting at least two organic acids or ester derived therefrom with one polyhydric alcohol, or (c) reacting at least two organic acids or esters derived therefrom with at least two polyhydric alcohols.

8. The container of claim 1 wherein said amorphous polyester is derived from a reaction among a terephthalate, an isophthalate, and a polyhydric alcohol.

9. The container of claim 1 wherein said amorphous polyester is derived from a reaction among a phthalic acid or derivative thereof, a glycol, and a second polyhydric alcohol.

10. The container of claim 1 wherein said innerseal has a tab extending from the periphery thereof.

* * * * *